US006015109A

United States Patent [19]

Ohlson et al.

[11] Patent Number: 6,015,109

[45] Date of Patent: Jan. 18, 2000

[54] THREAD FEED DEVICE

[75] Inventors: Per Ohlson, Tvaerred; Kurt Arne Gunnar Jacobsson, Ulricehamn, both of Sweden

[73] Assignee: Memminger-IRO GmbH, Dornstetten, Germany

[21] Appl. No.: 09/051,066

[22] PCT Filed: Oct. 10, 1996

[86] PCT No.: PCT/EP96/04409

§ 371 Date: Jun. 29, 1998

§ 102(e) Date: Jun. 29, 1998

[87] PCT Pub. No.: WO97/14836

PCT Pub. Date: Apr. 24, 1997

[30] Foreign Application Priority Data

Oct. 16, 1995 [DE] Germany ..... 195 38 449

[51] Int. Cl.[7] ..... B65H 51/00

[52] U.S. Cl. ..... 242/364.7; 242/364.9; 242/365; 242/365.1; 192/223

[58] Field of Search ..... 242/364.7, 364.9, 242/365, 365.1; 188/82.1, 82.77, 82.8; 192/223

[56] References Cited

U.S. PATENT DOCUMENTS

| | | | |
|---|---|---|---|
| 2,685,350 | 8/1954 | Falk | 188/82.77 |
| 3,642,219 | 2/1972 | Rosen | 242/364.7 |
| 3,717,312 | 2/1973 | Rosen | 242/364.7 |
| 3,904,141 | 9/1975 | Rosen | 242/364.7 |
| 4,165,049 | 8/1979 | Pejchal et al. . | |
| 5,590,547 | 1/1997 | Conzelmann | 242/365.1 X |

FOREIGN PATENT DOCUMENTS 27 25 185 9/1978 Germany .

*Primary Examiner*—Michael R. Mansen
*Attorney, Agent, or Firm*—Flynn, Thiel, Boutell & Tanis, P.C.

[57] ABSTRACT

In a yarn feeder, particularly for knitting machines, having a stationary housing and a rotational element which can be driven by a motor for winding on a yarn, and having a mechanical backturn-detent mechanism for the rotational element, which mechanism contains a detent member which is displaceable on a counter-member between a running position and a blocking position, in which blocking position the detent member engages at a braking surface. The detent member underlying a permanent drag power in each rotational direction which drag power is generated by means of friction contact in case of a rotational movement of the rotational element for displacing the detent member in dependence from the sense of rotation and in relation to the counter member either into the running position or into the blocking position. The counter-member and the detent member consist of ring bodies which are set within each other and which are rotatable in relation to each other about the rotational axis of the rotational element. The detent member co-operating with the braking surface in the braking position of the backturn-detent mechanism being provided at its periphery with a counter-braking surface range which is limited in a circumferential direction.

17 Claims, 3 Drawing Sheets

THREAD FEED DEVICE

FIELD OF THE INVENTION

The invention relates to a yarn feeder having a mechanical-backturn-detent mechanism.

BACKGROUND OF THE RELATED ART

U.S. Pat. No. 3,642,219 discloses a known yarn feeder which has been sold by the applicant for more than 20 years as yarn feeder SFS-SFT. The backturn-detent mechanism schematically shown in U.S. Pat. No. 3,642,219 is provided between a top wall of an electro motor integrated into the storing drum and a bearing arrangement of an advance element secured to a shaft which is fixed to the housing. The detent-member co-operates with the interior circumference of the storing drum on a relatively big diameter. In this yarn feeder SFS/SFT as used in practice the detent-member is a disc made from plastic. The disc is displaceable between the running position and the braking position within a fork like counter-member secured to the shaft. The disc is displaceable by means of a drag force generated by friction contact between one front surface of the disc and the top wall of the motor. The counter-member is provided with a concave sliding track for the disc ascending in backturn direction. In the running position the disc is essentially released from its engagement with the braking surface provided at the interior periphery of the storing drum. Upon occurrence of a backturn of the storing drum the disc becomes displaced by means of the drag force alongside the slide track into the brake position, in which the disc is pressed against the braking surface. A backturn motion of the storing drum might have several reasons. A spring-loaded yarn detector at the input region of the yarn feeder is able to pull back the incoming yarn upon a stop of the storing drums and might turn back the storing drum by means of the tensed yarn. Furthermore, the yarns processed frequently are elastic. Upon a stoppage of the storing drum the tension generated beforehand in the incoming yarn tends to turn back the storing drum via the yarn. Finally, due to inappropriate circumstances and because of an intentionally controlled braking of the motor a counter-torque can be created which tends to turn back the storing drum. The known backturn-detent mechanism is complicated to manufacture, underlies significant wear and may cause vibrations when accelerating the motor or with high speeds, because the disc is active at an extremely big diameter and with a very long lever arm. The known backturn-detent mechanism requires an almost exactly vertical arrangement of the yarn feeder which cannot be achieved in some practical cases. In addition complicated structural measures are necessary to avoid burning of the disc at its front surface contacting the top wall of the motor, said burning resulting from the big distance of the contact area from the rotational axis and the thus significant friction power which has to be dissipated under high rotational speed.

It is an object of the invention to provide a yarn feeder as disclosed with a structurally simple, easy mountable backturn-detent mechanism reliably operating with reduced wear and endurance and which does not cause vibrations.

SUMMARY OF THE INVENTION

Said object can be achieved with a yarn feeder having a detent member which contacts a braking surface over a limited circumferential extent to prevent backturn.

As the drag power is precisely adjustable a significant influence of the backturn-detent mechanism under high speed conditions of the rotating element is eliminated. This is of particular advantage for modern type yarn feeders, the rotational speeds of which is increased by about 20% in comparison to already used known yarn feeders. The braking surface can be provided at a diameter which is significantly smaller than the inner diameter of an optionally provided storing drum. If the rotational element shows the tendency of the backturn motion the detent member is rotated in relation to the counter-member in a smooth rotation by means of the drag power until its counter-braking area is displaced outwardly or inwardly against the braking surface due to the circle which is excentrically offset to the rotational axis so that the backturn motion becomes blocked. The engagement into the braking position takes place harmonically and reliably. A high braking-efficiency can be generated. Of particular importance is that the detent member can be easily and forcibly released from the braking surface as soon as the rotational element restarts the run with the correct sense of rotation. The detent member then returns reliably in the defined running position. The range of engagement between the detent member and the braking surface can be designed with a big surface, so that no excitation of vibrations is caused in the yarn feeder. The backturn-detent mechanism operates with low-wear and reliably for long durations. It is to be noted that by selecting the eccentricity and the diameter of the excentrical circle the characteristics of the operation of the backturn-detent mechanism when engaging or being released can be predetermined precisely and optimum.

Where the braking surface diameter is significantly smaller than the storage drum diameter, the backturn-detent operation is carried out at an optimum small diameter and particularly at a diameter which is completely independent from the size of the storing drum.

The drag power can be pre-determined by pressing the detent member against a drag surface with a spring and exactly by pre-selecting the spring force. Optionally the pressing of the detent member is carried out against the action of gravity. The yarn feeder accordingly can be mounted for operation in any operating position without jeopardising the backturn-detent. In addition the area of contact between the detent member and the drag surface can be set relatively close to the rotational axis of the rotational element so that even with high rotational speeds and strong accelerations the danger of burning of the detent member is avoided, enhanced by the annular shape of the detent member which allows a relatively low specific area pressure per area-unit but nevertheless assures a sufficient drag power.

Even though the detent member automatically is rotated into a blocking position which exactly suffices to suppress a backturn and without the help of a particular abutment for the blocking position, it might be useful to provide a separate abutment for the detent-member said abutment defining a final-blocking position and avoiding excessive lateral forces for the braking surface or for the rotational element.

The embodiment where the rotational element is a motor shaft arranged in a housing is particularly useful. The motor is secured to the housing. The backturn-detent mechanism is well encapsulated and separated from the operational area of the storing drum in which dirt and lint unavoidably are present. Since the detent member does not cooperate any more with the inner diameter of the storing drum the diameter of the braking surface can be selected small enough in order to exclude vibrations at high speeds and strong accelerations normally present in modern yarn feeders.

Where the counter member is secured on the motor shaft, the motor shaft is blocked against a backturn motion by means of the running-with backturn-detent mechanism.

Alternatively the backturn-detent mechanism does not follow the rotational movement of the rotational element where the motor shaft defines the braking surface. The backturn-detent mechanism only is brought into action in case of a backturn in order to block the motor shaft via the braking surface which, e.g. is provided at the motor shaft.

Where a braking ring is provided that is made of a friction active material, the detent-member is co-operating with the braking ring assuring a high-braking efficiency by its material.

Alternatively, a braking ring could be provided directly on or within the detent-member.

A high backturn-detent operational efficiency can be achieved with a braking surface which is only equipped with a surface structure, e.g. made by knurling. Said braking surface can be provided within a metallic body, e.g. in the housing or in a housing-insert, and thus can be a metallic surface.

The embodiment where the counter-member and detent member are made of plastic-form parts is easy to manufacture. Plastic-form parts are superior due to high dimension preciseness, low weight and low wear. Since the detent-member is pressed by means of a precisely adjustable spring force against the drag surface, self-lubricating plastic materials may be used which assure a smooth rotatability of the detent-member over long duration. The self-lubricating effect does not negatively influence the braking effect at the braking surface, because a quick and forced engagement takes place by means of the excentrical displacement of the detent-member.

The embodiment where the counter-member is a hub on the motor shaft is easy to mount and assures a wear-poor operation for long durations.

In this embodiment, the spring is an integrated component between the annular disc and the hub of the backturn-detent mechanism. The projections or the enlargement are part of a mounting assistance (in order to pre-mount such units), because the annular disc cannot fall off the annular flange, even under the spring load. In operation the annular disc normally does not move up to the projections or the enlargement.

BRIEF DESCRIPTION OF THE DRAWINGS

Embodiments of the object of the invention will be explained with the help of the drawings. The drawings show.

DETAILED DESCRIPTION

Figure 1:
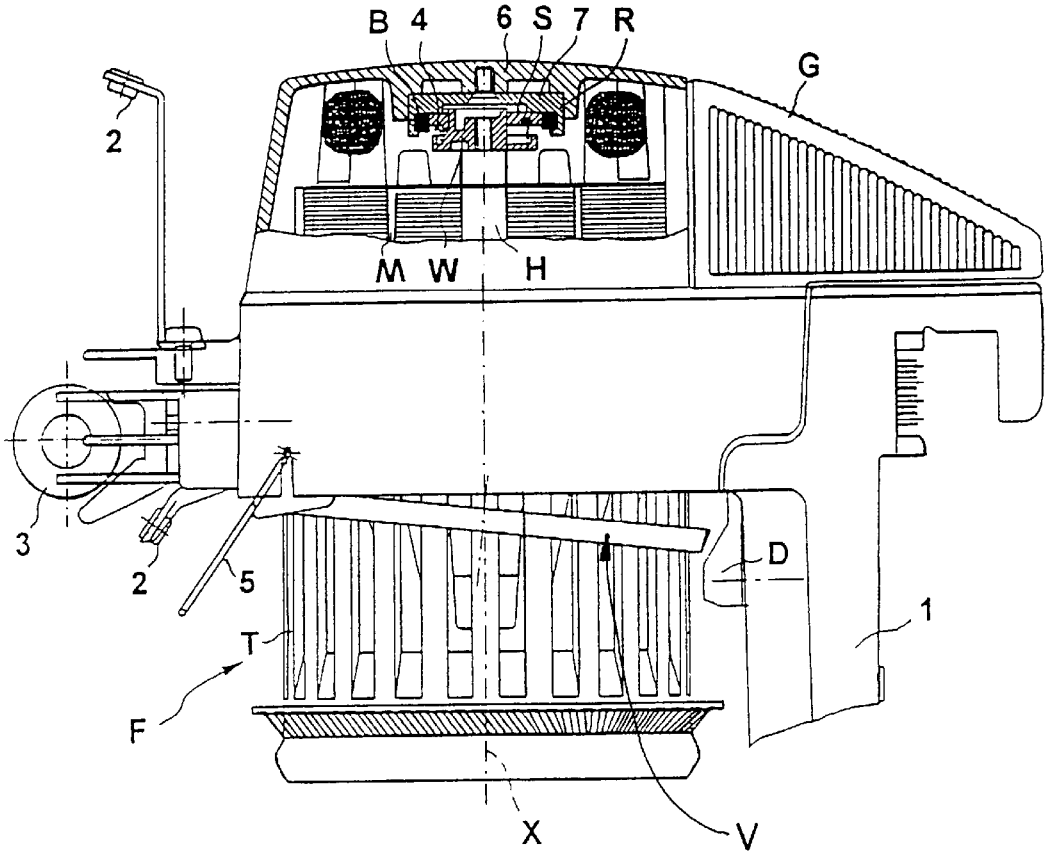
FIG. 1: a side view, partially in section, of a yarn feeder having a backturn-detent mechanism.

A yarn Feeder (F), particularly a yarn feeder (F) for a knitting machine, is provided with a stationary housing (G), on the lower side of which a storing drum (T) is supported in a rotatable fashion for a rotation about a rotational axis (X) by means of a motor (M) in a predetermined sense of rotation. The motor (M) can be switched on and switched off by means of signals originating from a detecting device (D) provided in a housing-bracket (1) and generated in dependence from the size of a yarn store (not shown) wound onto the storing drum (T). The yarn supplied to the storing drum (T) from a (not shown) yarn bobbin is guided through stationary eyelets (2) and through a yarn brake (3) and reaches under surveillance of a detecting element (5) the periphery of the storing drum (T). An inclined advance element (V) of the storing drum (T) pushes each winding wound onto the storing drum (T) in FIG. 1 downwardly, so that the yarn store is formed from a plurality of windings. The yarn is withdrawn for consumption overhead of the storing drum (T).

In the yarn feeder (F) a backturn-detent-mechanism (R) is provided, particularly between an upper top wall (6) of the housing (G) and the upper end of a motor shaft (H). The backturn-detent mechanism (R) contains in the embodiment of FIG. 1 a counter-element (W) fixedly secured to the motor shaft (H) and a detent member (5) which is rotatably supported on the counter element (W) for a relative rotation and which is biased by a weak coil spring (4) upwardly. The detent member (S) serves for co-operation with a braking surface (B) in an insert (7) in a top wall (6), particularly for hindering a backturn-motion of the storing drum (T) or the motor shaft (H) respectively, upon a stand-still.

Figure 2:
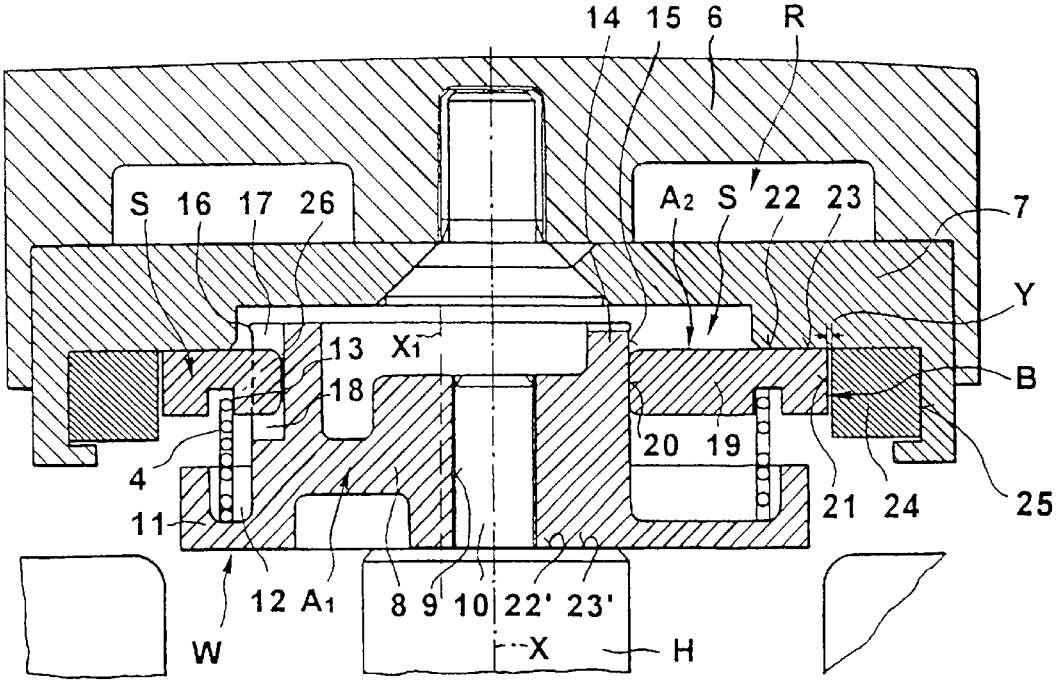
FIG. 2: the backturn-detent mechanism in a section and in enlarged scale, in a running position.

According to FIG. 2, the counter-member (W) is a ring-body (A1) consisting of a hub (8) which is fitted with a polygonal interior bore (9) onto a respective end (10) of the motor shaft (H) in a secured manner, of a radial flange (11) defining a spring seat (12), and of an axial annular flange (14) having a cylindrical exterior peripheral surface (15) the axis (X1) of which is eccentrically arranged in relation to the rotational axis (X) of motor shaft (H). In addition there is provided a cut-out (17) formed into the annular flange (14) with an extent limited in circumferential direction, which defines two circumferentially spaced abutments (18 and 18'). At the end portion of the annular flange (14) a circumferentially extending enlargement (16) is formed.

The detent member (S), is journalled on the counter-member (W) in a rotatable fashion. It also is a ring-body (A2), namely an annular disc (19), having an inner bore (20) and a cylindrical outer peripheral surface (21) which is determined for co-operation with the braking surface (B). The center axis of the peripheral surface (21) coincides in the shown running position of the backturn-detent-mechanism (R) with the rotational axis (X) at least substantially. The centre axis of the inner bore (20) coincides with axis (X1) being eccentrically arranged in relation to the rotational axis (X). In one front surface of the annular disc (19) a spring receiving groove (13) for the coil spring (8) is formed concentrically to the peripheral surface (21). The spring (4) rests with its other end in spring seat (12) of flange (11) and presses the annular disc (19) at least with a portion (22) of its other front surface against a drag surface (23) provided in a stationary fashion in relation to the housing (G). A nose (26) projects into the inner-bore (20) of annular disc (19) and defines according to FIG. 4, abutments (27, 27'), respectively, for co-action with abutments (18 and 18'), respectively, for defining the running position and the detent position. The braking surface (B) and the drag surface (23) are provided in the insert (7) which is secured to the top wall (6). It is possible to provide the drag surface (23) and the braking surface (B) directly in the top wall (6).

The braking surface (B) in this embodiment is provided on a braking ring (24) of frictionactive material as rubber, elastomer or another type of plastic material secured and held in a seat (25) of insert (7). In the running position as shown in FIG. 2, in which the backturn-detent-mechanism (R) does not influence the normal rotation of motor shaft (H), a radial clearance (Y) is defined between the peripheral surface (21) and the braking surface (B).

Both ring bodies (A1, A2) advantageously are plastic-formed parts, e.g. injection moulded parts. The insert (7) can be made of metal, e.g. from steel. The braking surface (B) alternatively could be provided directly at the inner peripheral wall of seat (25) and may advantageously have a rougher surface structure, e.g. made by knurling. Also the peripheral surface (21) could be equipped, if necessary, with a structure in order to improve the friction engagement.

Figure 3:
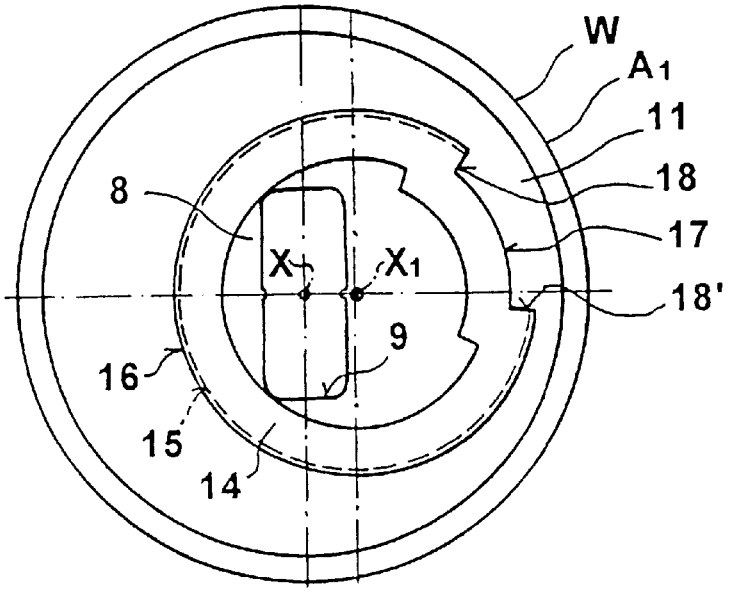
FIG. 3: an axial plain view on a counter-member of the backturn-detent-mechanism.
Figure 4:
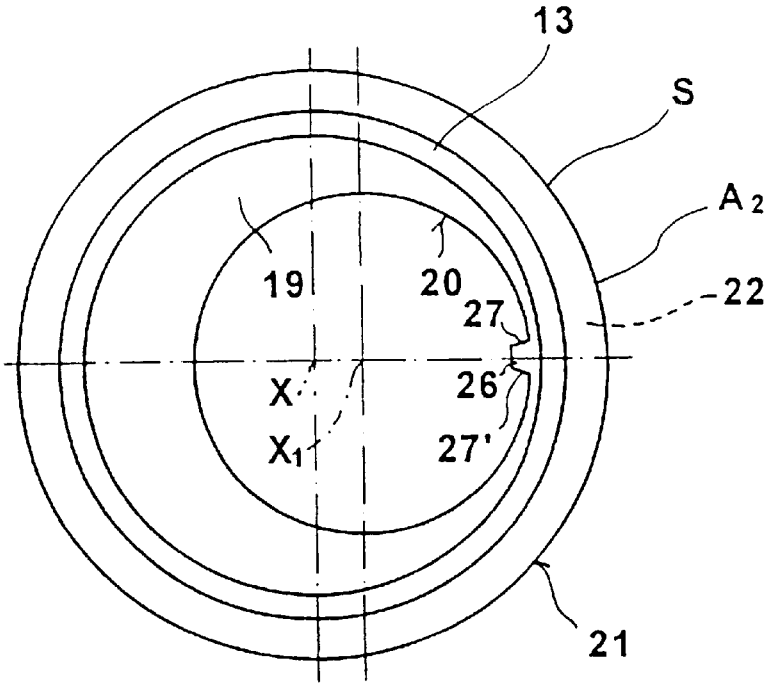
FIG. 4: an axial plain view of a detent member of the backturn-detent mechanism fitting onto the counter member of FIG. 3, and FIG. 5: is a schematic detail of the embodiment of the backturn-detent-mechanism of FIGS. 2, 3 and 4, FIG. 6: is a schematic detail of an alternative embodiment of the backturn-detent-mechanism.

In the running position the detent member (S) according to FIG. 4 is seated in the rotational position of FIG. 4 on the annular flange (14) of counter-member (W) which itself is positioned in the rotational position as shown in FIG. 3. The nose (26) abuts with abutment (27') on abutment (18'). The peripheral surface (21) then is essentially concentrically with respect to rotational axis (X) and faces the braking surface (B) (FIG. 2) with radial clearance (Y). The motor shaft (H) as driven in FIGS. 3 and 4 in anti-clockwise direction rotates by means of counter-member (W) also the detent member (S), but without contact with braking surface (B). By means of the load of spring (8) detent member (S) is pressed against the drag surface (23) so that by means of friction contact a permanent drag power is active on detent member (S) which drag power maintains detent member (S) with its abutment (27') at abutment (18').

Upon a stand-still of motor shaft (H) and in case of a backturn (rotation of the motor shaft (H) in FIGS. 3 and 4 in clockwise direction) a drag force is produced on detent member (S) in anti-clockwise direction by means of the contact with the drag surface 23. Said drag power rotates the detent member (S) relatively to counter-member W on its annular flange (14), by which relative rotation the peripheral surface (21) of detent-member (S) is displaced outwardly and hits braking surface (B) with a counter-braking range which is limited in circumferential direction. A further backturn motion of motor shaft (H) is hindered. Even abutment (27) of nose (26) may then reach abutment (18) of the annular flange (14).

If then the motor shaft (H) is driven in the correct direction, i.e. in FIGS. 3 and 4 in anti-clockwise direction, the drag power at the drag surface (23) retains detent member (S) from following this rotation. The peripheral surface (21) becomes released from braking surface (B) and again will become centered in relation to rotational axis (X).

A kinematical inversion of the kind is possible that the ring body (A2) is fixedly secured at the top wall (6) or insert (7), while ring body (A1) rotatably surrounds the motor shaft (H) or its end (10) (which then has to have a cylindrical periphery), advantageously again with radial clearance. Front surface (23') of motor shaft (H) then serves as the drag surface co-operating with the front surface (22') of ring body (A1) under the pre-load of coil spring (4). The braking surface (B) then can be provided either on the outer circumference of the motor shaft (H) or in the inner bore (9) of ring body (A1). In the latter case the ring body (A2) defines the counter member (W), while ring body (A1) defines the detent member (S). The braking ring may also be surrounded by the detent ring, and the braking surface and drag surface may be defined by an insert held by the motor shaft.

Figure 5:
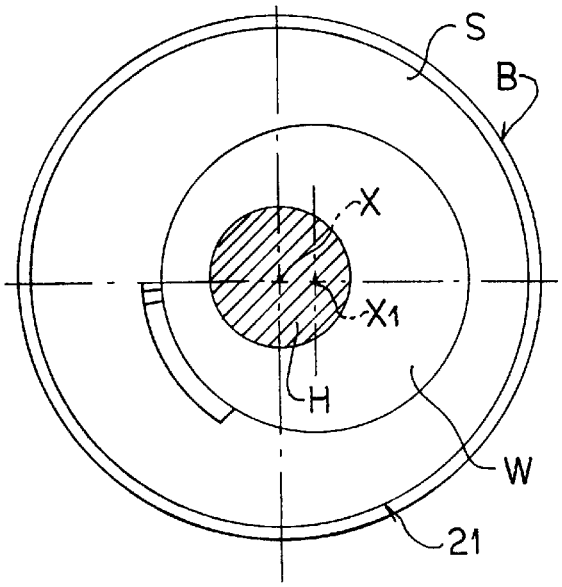

FIG. 5 schematically illustrates the embodiment as shown in FIGS. 2, 3 and 4. The detent member (S) is rotatably supported on the exterior of counter-member (W) and co-operates with the exteriorially arranged braking surface (B).

Figure 6:
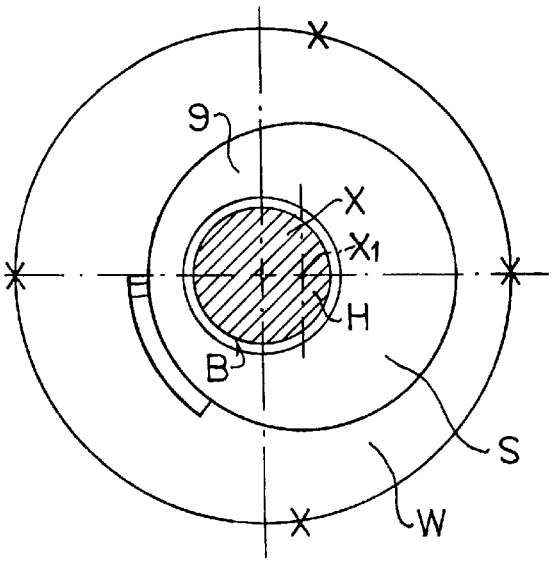

In FIG. 6 the kinematical inversion of said principal is illustrated. The counter-member (W) is provided externally on the detent member (S) and is fixedly secured (indicated by crosses). The detent member (S) is rotatable in relation to motor shaft (H). The braking effect takes place between the inner bore (9) and the braking surface (B) or the outer periphery of motor shaft (H) respectively.

Figure 7:
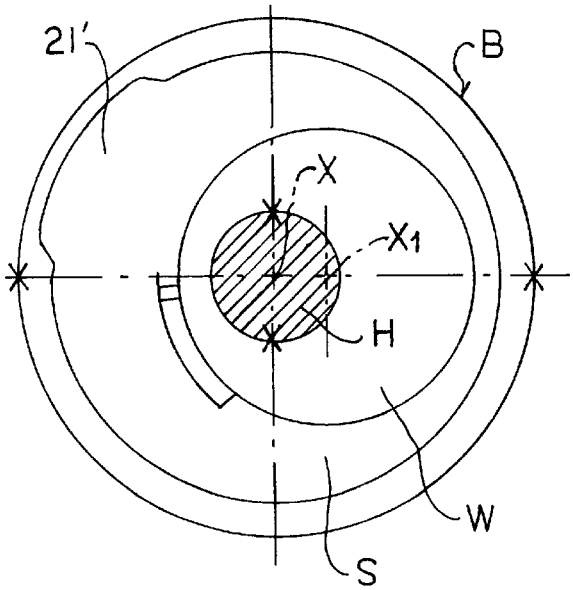
FIG. 7: is a schematic detail of another alternative embodiment of the backturn-detent-mechanism.

In the embodiment according to FIG. 7, which schematically corresponds to the function principal of FIG. 5, at the peripheral surface (21) of detent member (S) a counter-braking surface range (21') protrudingly is formed on peripheral surface 21 with a limited circumferential extent. Range (21') is determined for co-operation with braking surface (B).

Figure 8:
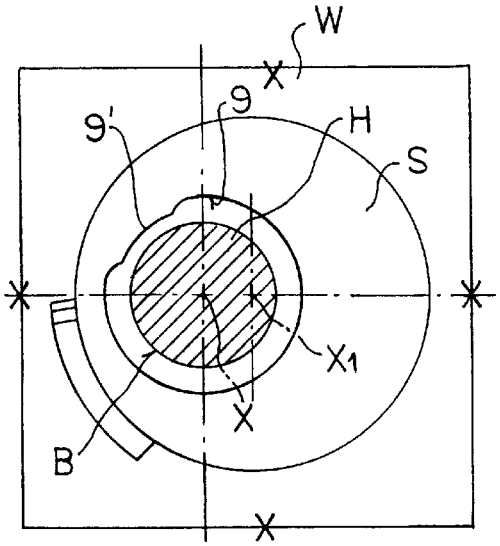
FIG. 8: is a schematic detail of still another alternative embodiment.

In a similar manner the embodiment of FIG. 8, which corresponds to the function principal of FIG. 6, in inner bore (9) of the detent member (S) a counter-braking surface range (9') is formed with a limited extent in circumferential direction and protruding inwardly for co-operation with the braking surface (B), which in this case is provided on the motor shaft (H). The counter-member (W) here is a ring body with polygonal outer periphery for facilitating the fixation of the counter member (W). In FIGS. 7 and 8 the counter-braking surface range (21', 9') respectively, can be made with a curvature the centre of which does not coincide with the centre of cylindrical surface (21 or 9 respectively), i.e. the range (21' or 9') could be curved stronger or weaker in order to assure a special braking effect.

The backturn-detent mechanism as shown in FIG. 1 also could be arranged below motor (M). Advantageously should the backturn-detent-mechanism (R) be encapsulated and separated from the influence of dirt and lint which unavoidably occur when processing yarn material. The diameter, at which the detent member co-operates with the braking surface (B) is advantageously smaller than the diameter of the storing drum (T) or its inner diameter, respectively. The size of the contact area between the detent member and the drag surface (23 and 23') ought to be selected so that with the pressure of spring (4) a drag power can be assured just sufficient for the function but low enough to eliminate the danger of overheating or burning the detent member.

We claim:

1. In a yarn feeder for knitting machines having a stationary housing, a storing surface for yarn, a motor and a rotational element which can be driven in a predetermined rotational direction by said motor which said motor can be switched off and switched on, said rotational element being rotatably supported by said housing and serving to wind yarn into a yarn store comprising a plurality of windings on said storing surface from which said yarn can be withdrawn for consumption overhead, said yarn feeder further having a sensor device for detecting movements of a boundary of said yarn store in a withdrawal direction and for generating signals to switch on or switch off the motor, and having a mechanical backturn-detent-mechanism which hinders a backturn movement of said rotational element, said backturn-detent-mechanism comprising a counter member, a braking surface, a first abutment and a detent member which is movable in relation to said counter member between a running position defined by said first abutment and a blocking position, said detent member engaging said braking surface when in said blocking position to prevent said backturn movement of said rotational element, said detent member being movable with a rotational movement of said rotational element in each direction of rotation by a drag power generated by friction contact between said detent member and a drag surface, said drag power displacing said detent member relative to said counter member independently of said direction of rotation either into said running position or into said blocking position, comprising the improvement wherein said counter member and the detent member are ring bodies which are set one within the other and are rotatable relative to each other about a rotational axis of said rotational element, said ring bodies having mutual areas of engagement therebetween which are defined by at least a section of a circle wherein said areas of engagement are disposed eccentrically relative to said rotational axis of said rotational element, said detent member including a peripheral surface which includes a counter-braking surface range which has a limited extent in a circumferential direction and cooperates with said braking surface when said detent member is in said blocking position to prevent the backturn movement of said rotational element.

2. The yarn feeder according to claim 1, wherein said storing surface is defined by a storing drum which has an inner diameter, a diameter of said braking surface being significantly smaller than said inner diameter.

3. The yarn feeder according to claim 1, wherein said backturn-detent-mechanism includes a spring which generates a spring force, said ring body that defines said detent member including a front surface which is pressed by said spring force in a direction essentially parallel to said rotational axis against said drag surface, said drag surface being defined on one of said housing or said rotational element.

4. The yarn feeder according to claim 1, wherein in addition to said first abutment which defines said running position, a second abutment is provided which limits the relative rotational movement between said ring bodies to define a final position for said blocking position.

5. The yarn feeder according to claim 1, wherein said rotational element is a motor shaft of said motor and said storing surface is defined by a storing drum, said motor being arranged inside said housing and said motor shaft fixedly carrying said storing drum, said housing having a housing wall opposite said storing drum and an insert which is held in said housing wall, said backturn-detent mechanism being provided between said housing wall and said motor on an extension of said motor shaft.

6. The yarn feeder according to claim 5, wherein said ring body that defines said counter member is fixedly held in a seat of said housing wall, said ring body that defines said detent member being journalled inside of said ring body of said counter member, said braking surface and said drag surface being defined on said motor shaft wherein said braking surface is disposed inwardly of said detent member and said drag surface faces a front surface of said detent member.

7. The yarn feeder according to claim 6, wherein said motor shaft includes an outer circumferential surface that defines said braking surface, said braking surface facing radially towards said peripheral surface of said detent member and said drag surface facing axially towards said front surface.

8. The yarn feeder according to claim 5, wherein said ring body that defines said counter member is fixedly secured on said motor shaft, said ring body that defines said detent member being rotatably supported at an exterior of said counter member, said braking surface being outside said detent member and said drag surface facing a front surface of said detent member wherein said braking surface and said drag surface are defined on said insert of said housing wall.

9. The yarn feeder according to claim 8, wherein said braking surface is formed by a braking ring made of a friction active material, said braking ring surrounding said detent member such that a radial clearance is defined therebetween when in said running position.

10. The yarn feeder according to claim 9, wherein said friction active material is a plastic material.

11. The yarn feeder according to claim 8, wherein said braking surface is surrounded by said detent member such that a radial clearance is defined therebetween when in said running position.

12. The yarn feeder according to claim 5, wherein said motor includes a motor shaft, and said ring body that defines said counter member comprises a hub which includes a polygonal inner bore that is fixedly secured to said motor shaft by said inner bore, said hub having an axial annular flange with a cylindrical outer periphery arranged eccentrically about a rotational axis of said motor shaft and a radial flange defining a spring seat, said outer periphery of said annular flange including said first abutment and a second abutment which are circumferentially spaced apart, said first and second abutments being retracted relative to or protruding over said outer periphery, said ring body that defines said detent member being an annular disc with said peripheral surface which is cylindrical and an inner bore, a center axis of said annular disc being eccentrically arranged in relation to a center axis of said peripheral surface and said inner bore of said detent member having an inner diameter which corresponds with an outer diameter of said flange of said hub, said inner bore of said detent member being provided with an inwardly projecting nose or an enlarged diameter which are limited in a circumferential direction.

13. The yarn feeder according to claim 12, which includes a coil spring, a front surface of said annular disc facing said flange and including a spring receiving groove which receives one end of said coil spring, said annular disc being disposed eccentrically about said rotational axis, the other end of said coil spring resting on a spring seat of said flange of said hub, said flange including a free end, and projections or circumferential enlargements being formed in the region of said free end.

14. The yarn feeder according to claim 1, wherein a braking ring made of friction active material is fixedly provided outside of said detent member, said braking ring defining said braking surface.

15. The yarn feeder according to claim 1, wherein said brakng surface is provided with a surface structure.

16. The yarn feeder according to claim 1, wherein both of said ring bodies are plastic-form parts.

17. The yarn feeder according to claim 1, wherein said drag surface is defined on one of said housing or said rotational element, said drag surface being in friction contact with said detent member.

* * * * *